United States Patent [19]

Baus

[11] Patent Number: 4,783,132

[45] Date of Patent: Nov. 8, 1988

[54] CUPBOARD, MORE PARTICULARLY FOR A BATHROOM

[76] Inventor: Heinz G. Baus, Wartbodenstrasse 35, CH-3626 Hünibach-Thun, Switzerland

[21] Appl. No.: 5,869

[22] Filed: Jan. 21, 1987

[30] Foreign Application Priority Data

Jan. 21, 1986 [DE] Fed. Rep. of Germany ..... 3601614

[51] Int. Cl.[4] ..... A47B 96/00

[52] U.S. Cl. ..... 312/324; 49/40; 312/110; 312/138 R; 312/263

[58] Field of Search ..... 312/324, 109, 110, 138 R, 312/263, 245, 257 R; 108/108, 110; 49/40, 116

[56] References Cited

U.S. PATENT DOCUMENTS

| | | | |
|---|---|---|---|
| 892,222 | 6/1908 | Carey | 49/40 |
| 1,033,711 | 7/1912 | Leland | 312/324 X |
| 1,702,178 | 2/1929 | Trammell | 49/40 X |
| 1,874,562 | 8/1932 | Mariotti | 49/40 |
| 1,934,929 | 11/1933 | Jonsson | 49/40 X |
| 2,507,342 | 5/1950 | Licari et al. | 312/324 X |
| 3,730,468 | 5/1973 | Magnusen | 108/108 X |
| 3,826,207 | 7/1974 | Sutherlan | 108/108 |
| 3,976,344 | 8/1976 | Frydman | 312/263 |
| 4,288,132 | 9/1981 | Znamirowski et al. | 312/263 X |
| 4,621,877 | 11/1986 | Boudreau et al. | 312/257 R |

FOREIGN PATENT DOCUMENTS

| | | | |
|---|---|---|---|
| 2116795 | 7/1972 | France . | |
| 693446 | 7/1953 | United Kingdom | 312/324 |

*Primary Examiner*—Peter A. Aschenbrenner
*Assistant Examiner*—Thomas A. Rendos
*Attorney, Agent, or Firm*—Foley & Lardner, Schwartz, Jeffery, Schwaab, Mack, Blumenthal & Evans

[57] ABSTRACT

A cupboard, more particularly for bathrooms and for the accommodation of bath utensils and the like, contains a housing with at least one pivotably arranged door for closing off or exposing an opening. Compact design, reliable operation and simple construction are to be achieved. To this end it is proposed that a second door be mounted to rotate about a second axis of rotation which is at a distance from the first axis of rotation. Each of the two doors which are pivotable in relation to each other, comprises, at the lower and the upper end, a bearing element which is mounted to rotate in the housing bottom and the housing top by means of pins.

27 Claims, 4 Drawing Sheets

FIG. 2
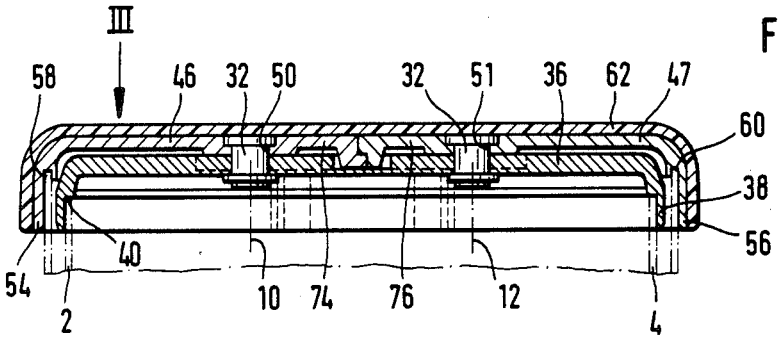
FIG. 3
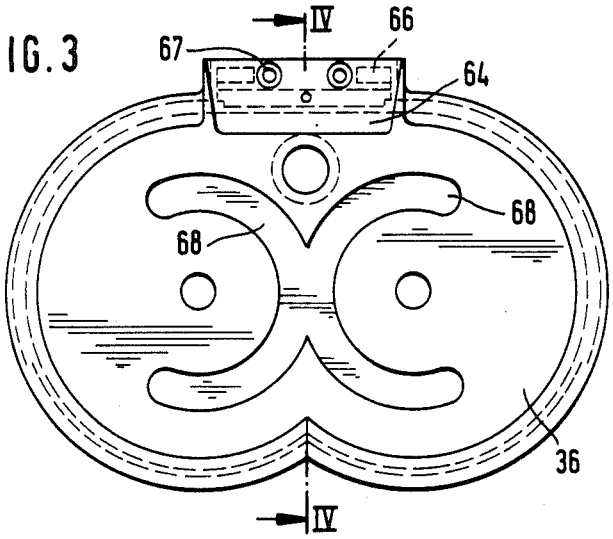
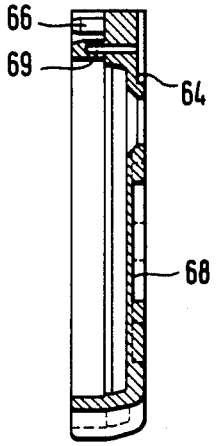
FIG. 4
FIG. 5
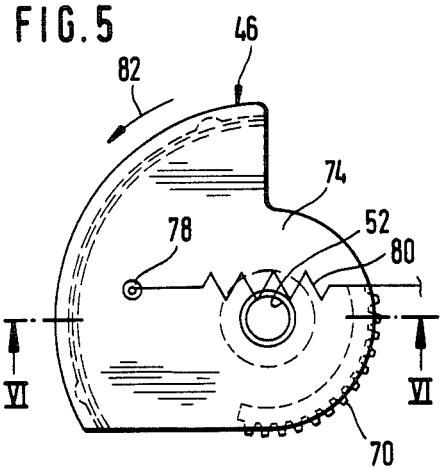
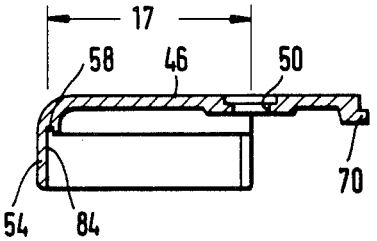
FIG. 6

CUPBOARD, MORE PARTICULARLY FOR A BATHROOM

BACKGROUND OF THE INVENTION

1. Field of the Invention

The present invention relates to a cupboard, more particularly for a bathroom.

In particular, the present invention relates to a cupboard, more particularly for a bathroom, for the accommodation of bath utensils or the like, with a housing having a curved wall, a bottom and a top, and with a door, arranged about an axis of rotation, for closing off or exposing an opening, located between two longitudinal edges of the housing.

2. Description of the Prior Art

Cupboards of this kind are known in the widest variety of configurations and are used, for example in a bathroom, for storing and keeping in readiness bathing and washing utensils, cosmetics and other things for daily personal hygiene. Mention is made here, by way of example, of so-called mirrored cupboards in which the outer surfaces of the doors carry flat mirrors. Also known are small cupboards, shelves, or the like which are to be arranged in a recess or in the corner of a room. Hitherto known cupboards have relatively large external dimensions, furthermore the interior of the housing is difficult of access. Problems arise in connection with the functional division and utilization of the interior and, especially if the depth is too great, parts in the rear area are not easily accessible.

French Pat. No. 21 16 795 discloses a cupboard having a cylindrical housing wall. The bottom and top of the housing contain annular grooves into which the lower and upper ends of the housing wall are inserted. The bottom and top of the housing are connected to each other by means of a central axis which passes through a central hole in the bottom, through the entire interior of the housing, and is connected to the top of the housing in a separate attachment device. Located in the interior of the housing is a round-about which is mounted to rotate about the said axis and serves to accommodate bottles. Provided for the purpose of closing off the opening is a curved door arranged in opposing annular grooves in the bottom and top of the housing. The radii of curvature of the door and of the guide-grooves must match exactly and close production tolerances must be adhered to. Both the housing and the door must be of sturdy construction, so that the pivotable door may be moved at any time; the resulting weight corresponds to the amount of material used. Furthermore, any foreign bodies lodging in the guide-groove may interfere with, if not completely prevent, free pivoting of the door.

OBJECTS OF THE INVENTION

It is an object of the invention to provide a cupboard combining simple and inexpensive construction with satisfactory access to the interior and compact design. The cupboard is to have a pleasing appearance, to be light in weight and to possess good stability. It is to be possible to produce and assemble the cupboard at low cost and reliable operation of the door or doors is to be assured. It must also be possible to arrange the cupboard, without difficulty, in a recess or corner-area of a room, the volume of the area in which it is suspended or set up being largely taken up by the said cupboard, thus providing optimal utilization of the available space.

SUMMARY OF THE INVENTION

In order to accomplish this object, according to the present invention there is provided, a cupboard, more particularly for bathrooms and for the accommodation of bath utensils, having a housing comprising a wall, a bottom, a top and a first door, adapted to rotate about an axis of rotation, for closing off or exposing an opening which is located between two front longitudinal edges of the housing, said cupboard comprising:

- a second door arranged to rotate about a second axis of rotation which is at a distance from the first axis of rotation;
- each of the two doors adapted to pivot in relation to each other comprises a bearing element at the lower and the upper end; and
- the bearing elements, and the doors are mounted to rotate in the bottom and the top of the housing by means of pins.

The cupboard according to the invention has compact external dimensions and provides for optimal utilization of the interior. Because there are two doors which pivot in relation to each other and have axes of rotation at a distance from each other, it is possible to close off or expose reliably a large opening in the housing, while taking up little space and maintaining a low weight. The bearing elements ensure reliable guidance of the doors at low structural cost, and it is not to be expected that contamination, foreign bodies, or the like will interfere with the operation thereof. The axially parallel, more particularly coaxial, housing walls and doors may be produced inexpensively and are preferably made of arcuate metal sections.

The housing walls and doors are preferably in the form of approximately quarter-circle shells, although shapes other than circular also lie within the scope of this invention. The axially parallel arrangement of the door- and housing-shells is important in that, in the opened condition, the opening, which extends over practically the total width of the cupboard, is substantially fully exposed.

Preferably, the distance between the housing shells and the front longitudinal edges is only slightly less (of a predetermined amount) than the total width of the cupboard, thus providing very satisfactory access to the interior and to intermediate shelves, hooks, or the like arranged therein. The intermediate shelves which, are adjustable in the direction of the longitudinal axes, are provided with an arcuate contour corresponding to the curved configuration of the housing- and door-shells. These intermediate shelves, and also the top and bottom of the housing, project partly beyond the opening and the plane extending between the two front longitudinal edges of the housing shells, access to the interior being considerably facilitated by this configuration which is essential to the invention.

The housing shells, and also the door-shells, may also be substantially straight and may comprise parts in the form of webs or the like, pivotability of the door-shells being assured, however, by an appropriate and predetermined arrangement of the longitudinal axes.

In the closed condition, the door-shells, which are pivotable in relation to each other, completely close off the opening and the cupboard as a whole. Thus if the cupboard is set up in a bathroom, or even in a shower-stall, sprayed water can be largely excluded.

The compact external contour, rounded off practically on all sides, not only provides an attractive appearance, but also ensures functional adaptation and integration, with optimal utilization of the available space. The comparatively slight depth of the cupboard is also important; in other words, the cupboard does not project too far into the bathroom, or wherever it is set up.

Preferably, the housing comprises, on the back of the housing shells, webs each extending substantially over the entire length, these webs being connected together preferably by means of a clamping section. Furthermore, the housing shells, and the webs in particular, comprise screw-channels which make it possible to secure the top and bottom of the housing, at the upper and lower end, by means of screws or the like. Production and assembly are to be carried out inexpensively, especially since the housing tops and bottoms are identical.

The housing shells are preferably made of metal sections and are inserted between the top and bottom of the housing. However, the two housing shells may be integral, together with the webs or the like, preferably of a synthetic material, so that they may be produced in suitable injection-moulds.

Preferably the housing shells, and also the two door-shells, extend over an angular range in excess of 90°, a range of the order of 110° having been found particularly suitable. The housing shells form the lateral walls and, at the same time, a part of the rear wall, the latter being completed by an attachment bracket arranged etween the housing shells. Preferably, the width of the attachment bracket is approximately equal to the distance between the longitudinal axes of the two housing shells. This distance is preferably of the order of 20% greater than the radius of the housing shells. As a result of this configuration, an identation is provided in the vicinity of the opening, the front edges of the two door-shells pivoting into such indentation. The cupboard also exhibits a somewhat oval ground-plan and has relatively little depth. This indentation in the front surface of the cupboard produces a particularly satisfactory design, but, this area may also be made flat, in order to increase the useful internal volume.

The bearing elements may be in the form of sectors engagine with the top and bottom of the housing by means of a lug or the like. These bearing elements may be in the form of caps, in order to close off the ends of the door-shells at right angles to the longitudinal axes.

The bearing elements also serve to stabilize and support the door-shells which may thus be made of relatively thin material. This also ensures that the doors and door-shells are highly resistant to twisting and can also move and pivot easily, even over a long service-life.

Preferably, each door-shell is inserted into recesses, grooves, or the like in the relevant cap which is made of an injection-moulded synthetic material. The bearing elements or caps may comprise edges adapted to the curved contour of the door-shells, these edges providing mounting, support and stability and also ensuring smooth running.

In one particularly advantageous embodiment, toothed quadrants or sets of teeth engaging one with the other are associated with the door-shells and, in particular with the bearing elements. These toothed quadrants substantially improve the actuation and manipulation of the unit. One door-shell may be actuated with only one hand in order to expose the opening in the cupboard fully or to close it.

BRIEF DESCRIPTION OF THE DRAWINGS

Preferred embodiments of the invention are explained hereinafter in greater detail as examples, without limitative manner which reference to the drawings wherein:

FIG. 2 is a cross-section, in parallel with the longitudinal axis, through the upper part of the cupboard;

FIG. 3 is a view of the top of the housing as seen in direction III according to FIG. 2;

FIG. 4 is a cross-section along the line IV according to FIG. 3;

FIG. 5 is a view of a bearing element and its teeth as seen in direction III according to FIG. 2;

FIG. 6 is a section along the line VI according to FIG. 5;

DESCRIPTION OF AN EXEMPLARY EMBODIMENT

Figure 1:
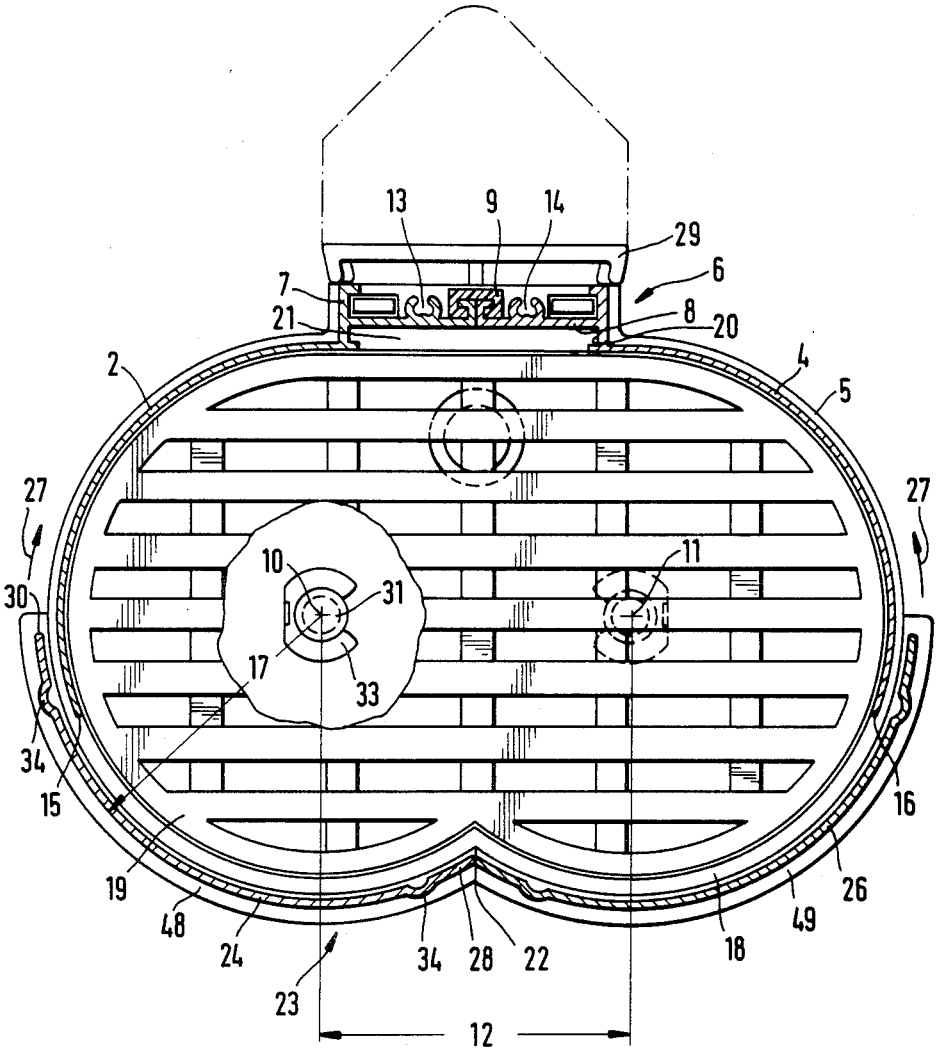
FIG. 1 is a cross-section, at right angles to the longitudinal axis, through the upper part of the cupboard.

The cross-section according to FIG. 1 shows two curved housing walls 2,4 comprising, in the vicinity of rear side 6 of the cupboard, webs 7,8 which, in turn, are connected together by means of a clamping section 9 extending over the entire length. Connection of housing walls 2,4 to an upper housing top and a lower housing bottom, which are identical and between which housing walls 2,4 are arranged longitudinal axes 10,11, is effected by means of screws, or the like, engaging from above and below in screw-channels 13,14 on the outside of webs 7,8. Housing walls 2,4 are in the form of arcs or parts of cylinders and extend around longitudinal axes 10,11 over an angular range of approximately 100°. Located between front longitudinal edges 15,16 of housing walls 2,4 is a free opening 18, through which the interior of the cupboard is accessible. In a plane parallel with opening 18, axes 10 and 11 are at a distance 12 from each other which is substantially equal to outside radius 17 of doors 24,26.

Located in the interior of the cupboard are intermediate shelves 19 arranged one above the other and spaced apart in the direction of axes 10,11, together with hooks, partitions or the like which are not shown but are secured to the attachment bracket made out of webs 7,8. To this end, the said attachment bracket, located in the middle of the cupboard, comprises an undercut longitudinal groove 20 into which the intermediate bottoms or the like, with appropriately designed retaining parts 21, are inserted. The connecting of housing shells 2,4, and in particular webs 7,8 thereof, by means of clamping section 9, ensures that, over the entire axial length, the opposing lateral walls of this undercut longitudinal groove 20 are spaced equally apart and cannot be forced outwardly. This ensures that the retaining parts 21 of intermediate shelves 19, and the hooks or the like, remain securely locked in longitudinal groove 20 even under load.

The whole cupboard, and also the shelves arranged therein, have an approximately oval ground-plan, with a front identation 22 in the vicinity of opening 18. Distance 12 between axes of rotation 10,11 corresponds substantially to the outside radius of housing shells 2,4 and is preferably of the order of 20% greater than this radius. The depth, i.e. the distance between identation 22 and the attachment bracket, is therefore relatively small and, in spite of the rounded housing shells, a narrow ground-plan is achieved. Identation 22 is thus brought about by the coaxial arrangement, according to the invention, of the housing shells and doors 24,26, and by their substantially arcuate or barrel-like design. Designs in which front surface 23, like back surface 6, are substantially flat are, of course, also within the scope of this invention. In all examples of embodiment it is essential that front longitudinal edges 15,16 of housing shells 2,4 be set back from the front surface or front side 23 towards the back. If the doors or rotating shells 24,26 are pivoted rearwardly in the direction of arrow 27, the interior of the cupboard is very accessible, in part even from the side also.

Doors, 24,26 are arranged coaxially with housing shells 2,4 around axes of rotation 10,11. The doors 24,26 are arranged externally around housing shells 2,4 with relatively little clearance. They also extend over an angular range in excess of 90°, preferably about 110°. If doors 24,26 are pivoted from the position shown, in the direction of arrow 27, about axes 10,11, away from opening 18, then this opening is exposed. The doors 24,26, like housing shells 2,4, are in the form of thin-walled metal sections which are brought to the necessary length corresponding to the length or height of the cupboard. Therefore, the overall length of the cupboard is thus easily predeterminable. In the vicinity of their front edges 28 and of their rear edges 30, doors 24,26 comprise outwardly projecting ribs 34 which may easily be grasped by the user for the purpose of opening or closing the cupboard. Although the coaxial arrangement is particularly practical, the axes of rotation of the doors may also be arranged at a distance from those of the housing shells. This is particularly desirable in the case of a design in which the external contour of the rotating shells is not circular as shown in the drawing.

Thus, for example, the parts in the vicinity of indentation 22, which are curved towards the back, may also be made flat, in order to produce a practically flat front surface in this area. In this case it is desirable for axes of rotation 10,11 of the door-shells to be moved away from the longitudinal axes of the housing shells, bearing in mind the radius of curvature. Located on back 6 is an element 29 for connecting the cupboard to the wall, designed to be screwed to the flat wall of a room. If the cupboard is to be installed in one corner of a bathroom or the like, the wall-element may also be of the shape shown in dotted lines. Arranged at the top and bottom of the wall-element is a stirrup comprising an arm, to be explained hereinafter, which facilitates simple attachment and assembly of the cupboard as a whole to the attachment bracket thus designed. As will be explained hereinafter, rotating shells 24,26 are secured pivotably to the top and bottom of the housing by means of pins 31, axial locking being effected by means of a clip or locking ring 33 engaging in an annular groove in a pin 31.

FIG. 2 shows a cross-section through the plane of axes 10,11 in the upper part of the cupboard, top cover 36 of the housing being visible. A bottom of similar design is provided at the lower end of the cupboard, the following explanations thus applying to both parts. Top 36 has an outer edge 38 against which the upper ends of housing shells 2,4 bear. The top contains a support-surface 40 which is defined by outer edge 38 and against which the axial end-surfaces of the two housing shells bear. As already indicated hereinbefore, the top and bottom of the housing are connected together by means of screw engaging in the screw-channels of the webs, the housing shells being clamped between the top and bottom in the manner shown. Assembly of the cupboard is thus extremely simple since, after the parts have been put together, there remain only the screw-connections between the top and the bottom of the housing and the attachment bracket.

Doors 24,25 are closed off at the top by means of bearing elements 46,47 in the form of caps which extend beyond housing top 36 and are adapted to pivot in relation to the top by means of pins or lugs 32. These lugs are located in upwardly expanded bores 50,51, they pass through housing top 36, under which they are held by clocking rings 33 and are thus secured against axial displacement. These explanations also apply to the identical bearing elements provided at the lower end of the cupboard. Each of the caps or bearing elements 46,47 comprises, in the vicinity of its outer edge 54,56, an annular groove 58,60 into which the upper ends of the door-shells 24,26 are inserted. Like door-shells 24,26, bearing elements 46,47 are arranged externally of the stationary parts of the cupboard, i.e. outside housing top 36 and housing walls 2,4, around which they are adapted to pivot in relation to spaced axes of rotation 10,11. Finally, a cover 62, engaging over bearing elements 46,47, is provided, on the one hand to provide a simple means for cleaning and, on the other hand, to prevent operational breakdowns or contamination of parts moving in relation to each other.

FIG. 3 is a plan-view of housing top 36. It also shows support-surface 64 for the previously mentioned arm of the attachment-bracket wall-connecting element. The rear webs and top 36 engage with each other by means of lugs 66, grooves, or the like, thus ensuring satisfactory mutual alignment and locking. Also shown here are two holes 67 in alignment with the previously mentioned screw-channels in the webs, screws being screwed through these holes for the purpose of connecting the housing top to the housing shells. Annular grooves 68 are also located coaxially with the axes in the outer surface of housing top 26, for the toothed quadrants to be explained hereinafter.

FIG. 4 is a cross-section along the line IV in FIG. 3, in which annular grooves 68 in the surface of housing top 36 are easily recognizable. Blind hole 69 serves to accommodate a screw which passes through the arm of the attachment bracket or wall-connecting element bearing upon support-surface 64, thus providing for simple attachment and assembly of the cupboard to a wall or the like.

FIG. 5 is a plan-view of bearing element 46 with quadrantal toothing 70. The other bearing element also exhibits corresponding toothing, the two sets of teeth engaging in each other. These sets of teeth extend into the above-mentioned annular grooves and engage with each other in the vicinity of the connecting line between the two longitudinal axes. Because of the arrangement of sets of teeth 70 in the annular grooves, they are practically invisible from the outside, and this considerably reduces the danger of contamination or penetration of foreign bodies. Sets of teeth 70 ensure movement of bearing elements 46,47 in opposite directions, together with the door-shells, and simple manipulation in opening and closing the cupboard. The sets of teeth are located in approximately semi-circular extensions to the bearing elements and caps and they extend over angular ranges of the order of about 110 to 130 angular degrees. Engagement is assured over the entire path of the pivoting motion, so that joint action may take place.

At least in the case of one bearing element 46 and extension 74 thereto, a spring-element 80 is secured to a small pin 78, the other end of the spring-element being secured to the housing top or to the other bearing element. The spring-element, which may also be in the form of a simple rubber ring, is arranged in such a manner as to provide a snap-mechanism for the purpose of moving the door-shells selectively into the closed or open position. Bearing element 46 is shown here in the open position of the cupboard, assuming the position in which it is pivoted towards the back of the cupboard. If guide-element 46 and the rotating shells are pivoted forwardly in the direction of arrow 82, pin 78 goes beyond the breakover point defined by the line connecting the two longitudinal axes and the preloaded spring-element causes the guide-element to move to the closed position. The spring-element is secured correspondingly to a pin on the relevant bearing element.

FIG. 6 is a cross-section through cap 46 showing clearly stepped hole 50 for the attachment pin and downwardly directed toothed quadrant 70. The axial end-face of the door-shell engages in annular groove 58 where it is functionally supported and locked. The door-shell, not shown here, bears against inner surface 84 of edge 54 and is reliably supported. The inner surface has a radius which matches the outside radius 17 of the door-shell.

Figure 7:
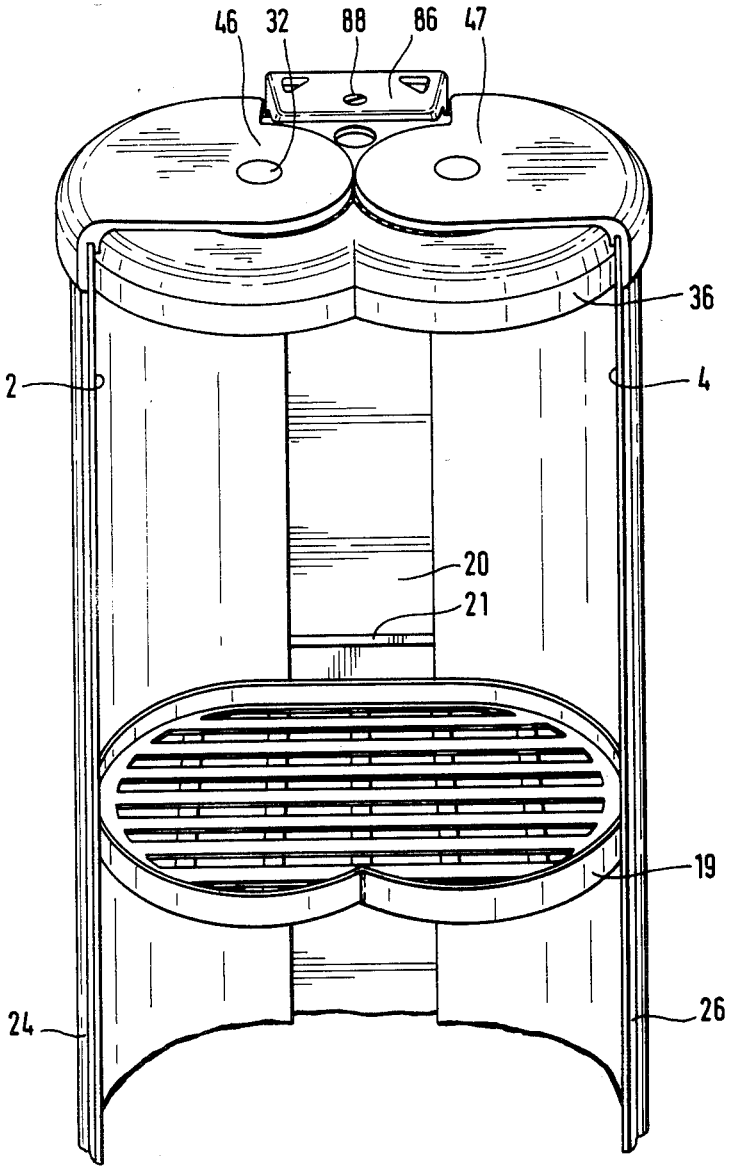
FIG. 7 is a perspective view of the upper part of the cupboard.

FIG. 7 is a perspective view of the upper part of the cupboard, the doors 24,26 being open and the opening between the front longitudinal edges of wall-parts 2,4 being exposed. Upper bearing elements 46,47, and pins 32, are easily recognizable. Intermediate shelf 19 is secured, with retaining part 21, in longitudinal groove 20 at the back of the cupboard. Arm 86 of the wall-connecting element is secured to housing top 36 by means of a screw 88.

Figure 8:
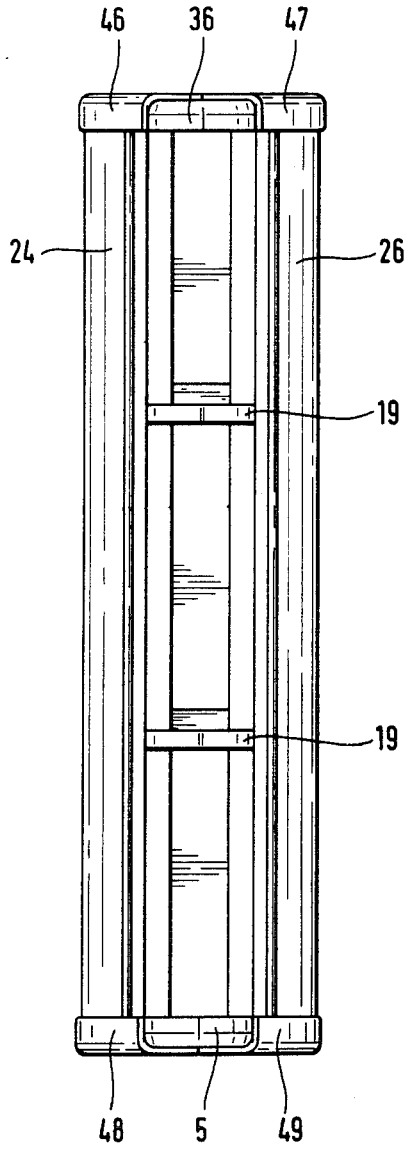
FIG. 8 is a view with the doors partly closed.

FIG. 8 is a view of the cupboard showing doors 24, 26, arranged, externally of the housing, partly closed. The interior of the cupboard is closed off at the bottom by housing bottom 5 and, at the top, by housing top 36 and contains two intermediate shelves 19 spaced apart in the longitudinal direction. Doors 24,26, in the form of rotating shells, have bearing elements 46,47 at the top in the vicinity of housing top 36, bearing elements 48,49 being provided accordingly at the bottom in the vicinity of housing bottom 5. The bearing elements 46 to 49 are arranged externally of the housing and surround housing top 36, housing bottom 5 and the housing walls.

I claim:

1. A cupboard comprising:

a housing formed from a top, a bottom and two opposed arcuate housing shells with vertically oriented longitudinal axes defining an enclosure with an opening located between two front longitudinal edges of said housing shells;

first and second arcuate door shells arranged to pivot about first and second spaced vertical pivot axes, respectively, between a closed position in which said door shells cover said opening and an open position in which said opening is exposed;

each of said door shells being mounted between an upper cap overlying the housing top and a lower cap underlying the housing bottom, said upper and lower caps being pivotably secured to said housing top and housing bottom, respectively, by means of upper and lower pins extending through aligned bores in the housing top and the housing bottom, respectively;

each cap having an arcuate groove receiving, and a vertically extending arcuate surface supporting, the full length of an arcuate upper or lower axial edge of a door shell mounted therebetween.

2. A cupboard according to claim 1, wherein said cupboard comprises a rear side provided with webs which extend over the entire length and which are connected together.

3. A cupboard according to claim 2, wherein said webs are connected together by means of a clamping section.

4. A cupboard according to claim 2, wherein said two housing shells are integral with the webs and are made of synthetic material.

5. A cupboard according to claim 2, wherein said webs are arranged in the middle of the cupboard and wherein an undercut longitudinal groove is provided at said rear side, between said webs, an intermediate shelf being secured in said undercut longitudinal groove by means of retaining parts.

6. A cupboard according to claim 5, wherein said housing shells are connected to said housing top and bottom by screw means engaging in screw-channels provided on the outer sides of the webs.

7. A cupboard according to claim 5, wherein the outer sides of the webs, comprise screw-channels and are arranged between a housing top and a housing bottom and are connected by means of screws engaging in said screw-channels.

8. A cupboard according to claim 1, wherein an attachment bracket, made out of webs, is arranged between rear longitudinal edges of the two housing shells.

9. A cupboard according to claim 8, wherein said attachment bracket is of a width which is between 10 and 30% greater than the outside radius of the housing shells.

10. A cupboard according to claim 9, wherein said width of said attachment bracket is 20% greater than the outside radius of the housing shells.

11. A cupboard according to claim 1, wherein said door shells have a larger radius than the housing shells.

12. A cupboard according to claim 1, wherein said door shells are arranged externally around the said housing shells.

13. A cupboard according to claim 1, wherein sets of teeth, in engagement with each other are associated with the caps, said teeth being arranged on sector-like extensions of the caps.

14. A cupboard according to claim 13, wherein a spring-element, in the form of a snap-mechanism, is associated with the door shells, by means of which said door shells are adapted to be moved selectively into the closed or open position.

15. A cupboard according to claim 14, wherein said door shells comprise, in the vicinity of their front edges outwardly projecting ribs.

16. A cupboard according to claim 14, wherein said doors comprise, in the vicinity of their rear edges outwardly projecting ribs.

17. A cupboard according to claim 1, wherein the distance between the pivot axes, lying in a plane parallel with the opening, is substantially equal to the outside radius of the door shells.

18. A cupboard according to claim 17, wherein said distance is larger up to 20% than the outside radius.

19. A cupboard according to claim 18, wherein said distance is up to 10% larger than the outside radius.

20. A cupboard according to claim 17, wherein said distance is up to 20% smaller than the outside radius.

21. A cupboard according to claim 20, wherein said distance is up to 20% smaller than the outside radius.

22. A cupboard according to claim 1, wherein said door shells each extend over an angular range of between 90° and 130°.

23. A cupboard according to claim 1, wherein the housing shells each extend over an angular range of between 90° and 130°.

24. A cupboard according to claim 1, wherein the door shells and the housing shells each extend over an angular range of about 110°.

25. A cupboard according to claim 1, wherein said housing shells are made of metal sections.

26. A cupboard according to claim 1, wherein said arcuate grooves and surfaces of the caps are coaxial with the pivot axis of the door shell mounted therebetween.

27. A cupboard according to claim 26, wherein said pivot axes of said door shells coincide with the centers of curvature of said arcuate housing shells.

* * * * *